US006435558B2

(12) United States Patent
Osawa

(10) Patent No.: US 6,435,558 B2
(45) **Date of Patent: *Aug. 20, 2002**

(54) ROLLER SKI BOARD

(76) Inventor: Kazuo Osawa, No. 3-4 Miyamachi, 3-Chome, Fuchu-shi, Tokyo (JP), 183-0023

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/517,200

(22) Filed: Mar. 2, 2000

(30) Foreign Application Priority Data

Mar. 3, 1999 (JP) ..... 11-100477

(51) Int. Cl.[7] ..... A63C 17/04
(52) U.S. Cl. ..... 280/842; 280/11.27
(58) Field of Search ..... 280/842, 843, 280/844, 11.221, 11.222, 11.223, 11.225, 11.232, 11.27, 11.28, 87.042; 301/5.3, 5.7

(56) References Cited

U.S. PATENT DOCUMENTS

| | | | | | |
|---|---|---|---|---|---|
| 2,253,012 | A | * | 8/1941 | Benner et al. | 280/842 |
| 3,722,900 | A | * | 3/1973 | Dickert | 280/842 |
| 4,182,520 | A | * | 1/1980 | Stevenson | 280/87.042 |
| 4,234,204 | A | * | 11/1980 | Tibbals | 280/87.042 |
| 4,460,187 | A | * | 7/1984 | Shimizu | 280/87.042 |
| 5,029,661 | A | * | 7/1991 | Wallace et al. | 280/87.042 |
| 5,096,225 | A | | 3/1992 | Osawa | 280/842 |
| 5,125,687 | A | * | 6/1992 | Hwang | 280/87.042 |
| 5,195,781 | A | | 3/1993 | Osawa | 280/842 |
| 5,340,132 | A | * | 8/1994 | Malewicz | 280/11.221 |
| 5,549,309 | A | * | 8/1996 | Gleichmann | 280/11.27 |
| 5,660,401 | A | * | 8/1997 | Yi | 280/87.042 |
| 5,673,941 | A | | 10/1997 | Osawa | 280/842 |
| 5,707,068 | A | * | 1/1998 | Bradfield | 280/87.042 |
| 5,855,385 | A | * | 1/1999 | Hambsch | 280/87.042 |
| 5,951,027 | A | * | 9/1999 | Oyen et al. | 280/11.28 |
| 5,975,542 | A | * | 11/1999 | Kaufman | 280/11.28 |
| 6,042,123 | A | * | 3/2000 | Eck, Sr. | 280/11.28 |
| 6,237,960 | B1 | * | 5/2001 | Dornhofer | 280/842 |

FOREIGN PATENT DOCUMENTS

| | | | | |
|---|---|---|---|---|
| CH | 169739 | * | 8/1934 | 280/842 |
| DE | 3037498 | * | 9/1982 | 280/842 |
| FR | 2585260 | * | 1/1987 | 280/842 |

* cited by examiner

*Primary Examiner*—Frank Vanaman

(57) ABSTRACT

A roller ski board similar to an ordinary snow ski board having a board body with bending elasticity and repellant property, and having at least one of single roller at its central portion and with or without smaller twin rollers at its front and rear edge portions, pivoted rotatively on an under surface of the board body along its longitudinal axis. The rollers have a lubricity and wear proof property with repellant elasticity so as to absorb the vibrations and shock added to the board from or to the ground during sliding. The rollers are arranged such that each external side periphery of the rollers is gradually wider from the central portion to a front and rear edge so that the external side peripheries of each roller does not protrude over the contour curvature of the board body. The rollers are also arranged consecutively from both the front and rear edges to the central portion such that each running surface of the rollers contacts with an arc curvature slightly curved upwardly over the ground. The single rollers have different diameters and the twin rollers the same diameter, and therefore are arranged at different ground contact levels so as to reduce frictional resistance during sliding. The vertical sectional surface of each single roller forms a small concave curvature with the contacting ground to achieve edging effects similar to an ordinary snow ski board.

28 Claims, 3 Drawing Sheets

ROLLER SKI BOARD

BACKGROUND OF THE INVENTION

1. Field of the Invention

This invention relates to an improved grass ski board, and more particularly to an improved roller ski board in which the speed, stemming, sliding and turning is more easily controlled than the known grass roller ski board and compares Customarily. various grass roller ski boards have been proposed for ski-training on snow free ground. However, the moving peculiarities for sliding, turning, braking, etc., are completely different from the ordinary ski board. due to their inherent length and construction that provided multiple rollers or a caterpillar on the bottom surfaces of the boards. respectively.

In view of such shortcomings in the known grass roller ski board, U.S. Pat. No. 5,096,225, U.S. Pat. No. 5,195,781 and U.S. Pat. No. 5,673,941, have been proposed to simulate the moving peculiarities of the ordinary ski board.

An improved roller ski board disclosed in those roller ski boards, particularly in U.S. Pat. No. 5,673,941, could remarkably improve the moving peculiarities such as for sliding turning or speed and the feel of such movements, in comparison with the ordinary ski board.

However, the known roller ski board has not yet been able to achieve the moving peculiarities like the ordinary ski board, due to the large resistance from the many main rotary rollers pivoting rotatively on the under-surface of the board.

BRIEF DESCRIPTION OF THE PRESENT INVENTION

The present roller ski board comprises a board body provided with multiple bearing portions on its undersurface and a plurality of single rollers pivoted rotatively on the bearing portions. The board body also is molded on the whole with the rather small size and an approximate same form as the ordinary ski board, from various single and compound materials having a flexible and repulsive elasticity.

Each single roller comprises a shaft supported firmly on the bearing portion of the roller ski board through a soft material and a single roller body supported rotatively on the shaft with a pair of rotary bearing portions. The pair of rotary bearing portions are molded from an organic material having a lubricative and wearing proof property, as an excellent rotary core material and formed on the whole with the single roller body of soft synthetic resin material to form the single roller.

Each single roller is further arranged along a longitudinal axis of the under-surface of the board at the same distance from their respective both internal lateral side edges.

Each single roller pivots rotatively at a level lower than the bottom-surface of the board so that tangential lines along the lateral outer side edges of each of the rollers do not protrude out from both lines along the lateral side edges of the board body. The body width at a central portion decreases gradually from each of the front and rear edges.

The board body is also formed in a shape of convex curvature slightly curved downwardly from a central portion to the front and rear both edges. Each roller is arranged on the under-surface of the board body and pivots rotatively at a respective position such that each circumference of the rollers contacts along a concave curvature slightly curved upwardly from a horizontal tangent line on running surface of the rollers at the central portion of the board to both the front and rear edges.

On the other side, the board has a plurality of rotative rollers at its central portion consecutive with each pair of rollers at both the front and rear edges. Respectively, which are of a smaller diameter than the rollers at the central portion and separated a little from the central rollers. All peripheries of the rollers are of a concave curvature to reduce the resistance of the board and to prevent an overturn of the user.

Additionally, the rollers are respectively supported on their respective shafts which are connected firmly on the bearing portion of the board through a bushing set of a soft material having a flexible and elastic property for absorption of vibrations and prevention of shock destruction to the board.

Further, the bearing portions of the board may be provided with slender through-holes, the roller bearings may also be set into the roller bearings or be provided with external circular holes about them; and the roller bodies may be arranged with many blind-holes or through-holes along their outer circular portions to provide a reduced weight for the board and absorption of the stress on the board or from the ground.

Accordingly there is disclosed an embodiment of a roller ski board which is almost of the same form and rather small dimension in comparison with an ordinary ski board and resembles closely with the same in operation.

There is also disclosed a roller ski board which is not only light and strong but also easily operative on a snow free area and has an excellent absorption capacity for shock and vibration as in an ordinary ski board due to the materials and construction of the roller ski board.

There is also disclosed a roller ski board which provides a plurality of rotative single rollers on its under-surface so that each circumference of the rollers contact with a concave curvature slightly curved upwardly to the front and rear edges from a central point of a horizontal tangent line on the under circumference of the rollers in the central portion of the board, to provide a decreased resistance between the roller sliding surface and the ground surface.

There is also disclosed a roller ski board with a plurality of rotative single rollers on it under-surface so that the distance of the internal lateral side edges of each roller arranged on a bearing decreases gradually from both the front and rear edges toward the central portion so as to form two tangent lines at the outer lateral side edges of each pair of the rollers accumulated with or within the lateral side lines of the board, for a smooth sliding and easy turning of the board.

There is also disclosed a grass ski roller board which provides a plurality of rotative single rollers at a central portion of an under-surface of the board consecutively and a respective pair of rollers at the front and rear edges somewhat separated from the central portion for prevention of an overturn of the user.

There is also disclosed a roller ski board which has rotatively a respective pair of smaller rollers that the central rollers at the front and rear edges, and in which all of the rollers are provided with a various uneven pattern on their running surfaces, such as a radial pattern, to provide an excellent edging effect similar to the ordinary ski board.

There is also disclosed a roller ski board which has on its under-surface a plurality of single rollers wherein their vertical sectional surfaces make respectively a small concave curvature slightly curved upwardly on the horizontal tangent line to achieve easily lateral inclination of the board to provide an excellent edging and a smooth operation.

There is also disclosed a roller ski board which has a plurality of single rotative rollers wherein each roller is supported on each shaft connected firmly with each bearing portion of the board through a respective bushing set of soft material to absorb vibration or the shock to the board.

There is also disclosed a roller ski board which has on its under-surface a plurality of rotative single rollers wherein each pair of roller sets into a pair of roller bearings to increase the sliding speed of the board.

There is also disclosed a single roller ski board which has a plurality of rotative roller pairs on its under-surface wherein each pair of rollers has various holes in the roller bodies for reducing weight and providing absorption of all stress to the board.

DETAILED DESCRIPTION OF THE INVENTION

Figure 1:
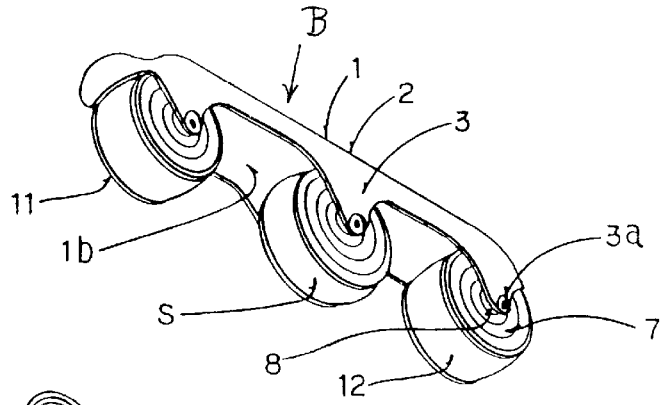
FIG. 1 is an upward perspective view of a roller ski board according to a disclosed embodiment of the invention.

The roller ski board B comprises a board body 1 provided with a plurality of bearing portions 3 which projects downwardly from both sides of the former and a plurality of single rollers S pivoted rotatively on the later. The board body 1 and the bearing portions 3, as shown in FIG. 1, are molded on the whole from a light material such as a synthetic resin, glass fiber and light metal or light compound material such as a plywood, etc., so that they have a flexible and torsional elasticity, as in an ordinary ski board.

Figure 7:
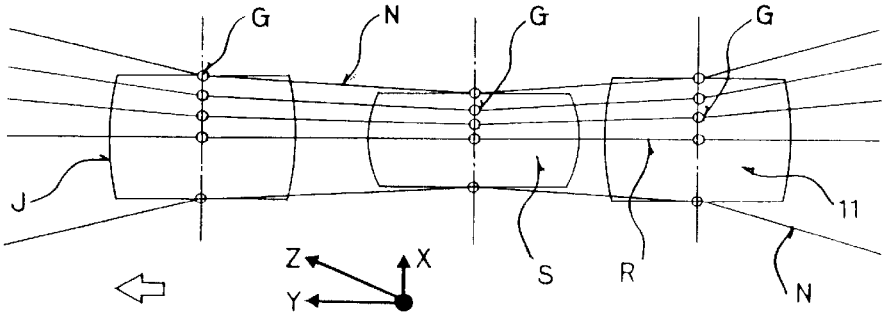
FIG. 7 is an enlarged bottom view of an embodiment of single rollers shown in FIG. 3 for an explanation of their sliding functions.
Figure 8:
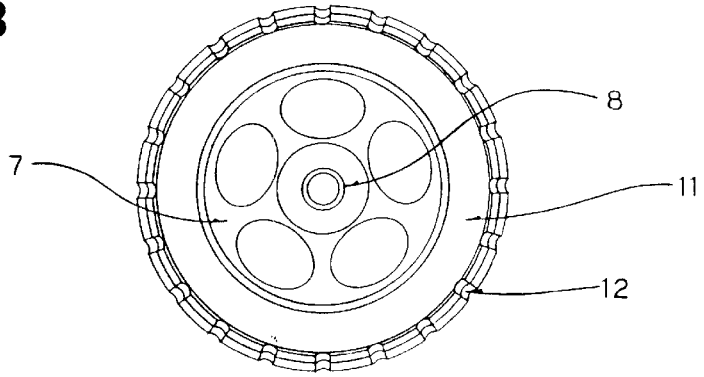
FIG. 8 is an enlarged front view of an embodiment of a roller.

As shown in FIG. 7, the roller is formed from a rotary wheel portion 7 as a core material. which has, respectively, a lubricative property, a superior wear proof property, a superior shock proof property and a lower frictional property. A roller body 11 has a soft roller main portion providing a superior repellant elasticity such as a urethane or rubber material and is provided with outer circular holes h about the rotary wheel portion 7 to reduce weight and increase durability.

Figure 6:
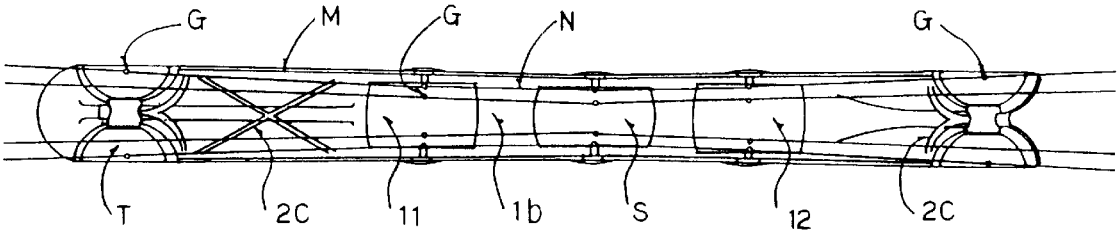
FIG. 6 is a bottom view of the roller ski board shown in FIG. 3.

The plurality of the single rollers S on the bearing portions 3 are mounted rotatively on the later at the same distance respectively and at a level lower than a bottom surface 1*b* of the board body 1, so that both tangent lines N alone the outer side periphery of each roller S do not protrude over the side lines M along the outside edges of the board body. and wherein the width of a central portion 2 decreases gradually from front to rear edges 2*a*, 2*b* to provide an easier smooth sliding, turning, circling, etc., than the known roller ski board which has a reversed configuration as compared to the roller ski board of an embodiment of the invention, as shown in FIG. 6.

The board body 1 is formed in the shape of convex curvature along its lateral axis such that both the front and rear edges 2*a*, 2*b* approaches equally to a horizontal tangent line H of central rollers S from the central portion 2, respectively, and the front edge 2*a* is formed the same as in an ordinary ski board which is slightly bent upwardly. The front and rear both edges are also on the whole curved with convex shape so that the single rollers are surrounded with them to prevent invasion of grass and dust, etc. and intersecting each other. All rollers S are arranged on the under-surface 1*b* of the board body 1 and respectively pivot rotatively at a respective position such that each circumference of the rollers contacts with a concave curvature L which is slightly curved upwardly from the horizontal tangent line H on the circumference of the roller S at the central portion 2 of the board 1 to both edges.

Figure 5:
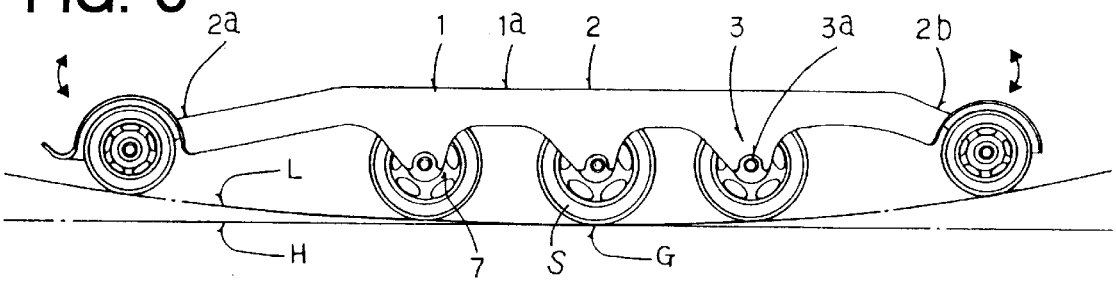
FIG. 5 is a front view of the roller ski board shown in FIG. 3.

On the other side, all single rollers S are arranged in such a manner that a plurality of larger rollers, for example, three rollers are set consecutively as the central portion 2 and two pairs of small rollers at both the front and rear edges, are separated from the central portion 2 so that all the peripheries of the rollers are on the concave curvature L as shown in FIG. 5.

Accordingly, as added load during sliding is distributed consecutively on a plurality of rollers S in the central portion 2 and the frictional resistance added on all rollers is decreased remarkably, while the small roller pairs on both edges 2*a*, 2*b*, which are respectively raised up and separated a little from the central portion 2, prevents an over-turn of the user when there is a movement along the vertical arrows as shown in FIG. 5 and when the balance of the user is disturbed for the same reason.

Additionally, all rollers S also pivot rotatively on the under-surface 1*b* of the board body to display the various moving characteristics of the edging effects decreased from the central portion 2 to front and rear edges 2*a*, 2*b* and to various uneven patterns formed on the roller surfaces.

Figure 9:
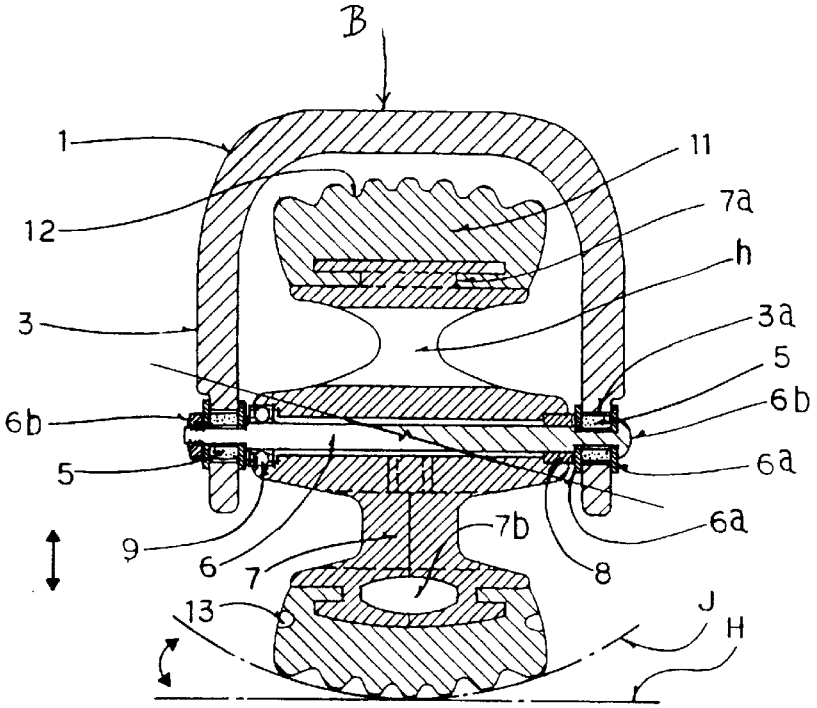
FIG. 9 is a vertical sectional view of an embodiment of a single roller.

Further, all rollers which pivot rotatively on the under-surface 1*b* of the board 1 are arranged so that a vertical sectional surface of each single roller S makes a small concave curvature J slightly upwardly as shown respectively by an arrow in FIG. 9, from the horizontal tangent H whereby when the board is subject to an incline laterally there is a remarkable decrease in the frictional resistance of the rollers S on the ground during sliding. Consequently, a smooth operation and excellent stability of the board can be achieved with the sharp edging effect of the outer periphery of the rollers S in the course of sliding.

A bushing set portion 5 held firmly on a roller shaft portion 4 is connected in a bearing through-hole 3*a* for bearing portions 3 on the under-surface 1*b* of the board body 1. The bushing set portion 5 is also made of rubber for absorption of vibration or of soft materials, such as polyurethane, etc., thereby providing an elasticity and vibration absorbing capacity to form a flex structure which absorbs shocks, vibration, etc., which takes place in the course of sliding.

Figure 2:
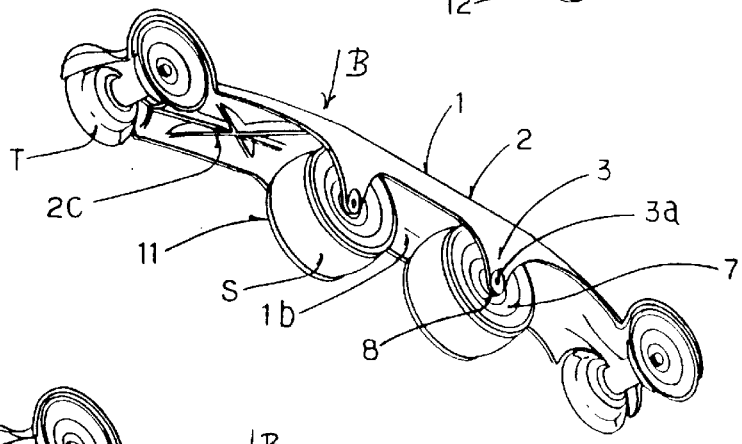
FIG. 2 is an upward perspective view of another embodiment of a roller ski board.

The board body 1, as shown in FIG. 2, is also molded on the whole from a light material having elastic property, as described hereinbefore, and two single rollers S at its central portion and two twin small roller T at its front and rear end portion, are arranged on its under-surface 1*b*.

The single rollers S are of the same diameter, respectively, and arranged the same distance from each twin small rollers T and further all rollers are in the same concave curvature, as mentioned for the roller board 1 in FIG. 1.

The single rollers S may be one or more rollers. and be set consecutively at the central portion 2 of the board body 1.

While, on the under-surface 1*b* of the front and rear edge portion of the board body 1, crossed projection 2*c* for reinforcement of the board body 1, may also be formed to increase it strength and to prevent intersecting each boards, during the sliding.

The roller ski board B described hereinbefore may be provided with a binding at the central portion 2 of the board surface la and used with a pair of boards with a known ski boot similar to the ordinary ski board; however, a wide single board may also be used for a pair of boards as a mono roller ski board.

Figure 3:
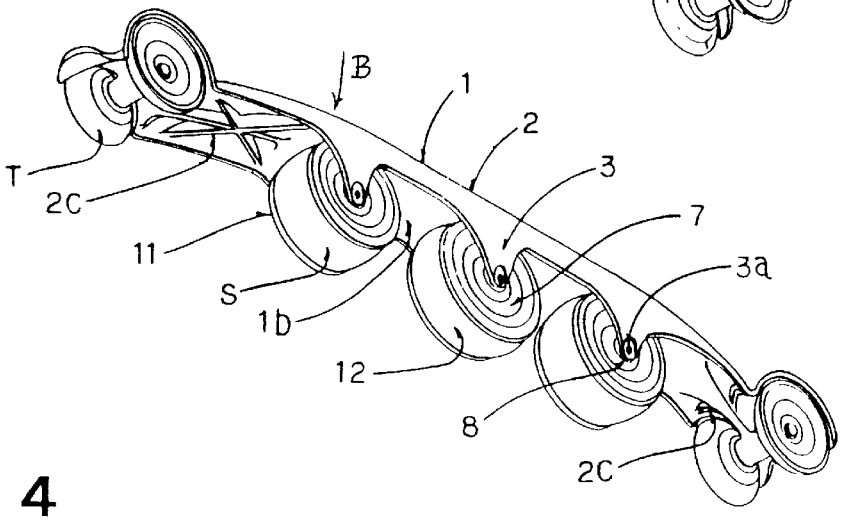
FIG. 3 is an upward perspective view of a further embodiment of a roller ski board.
Figure 4:
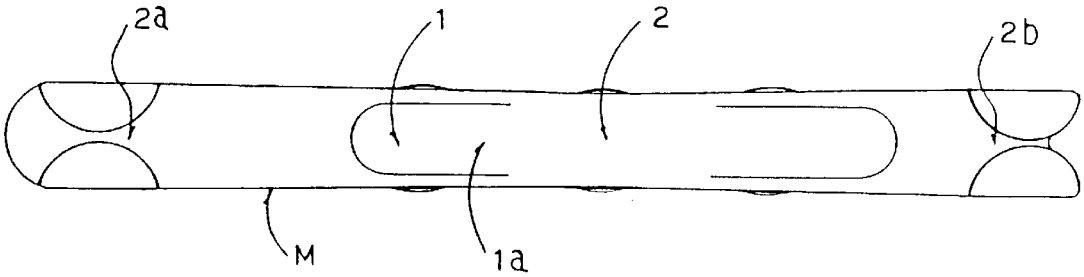
FIG. 4 is a plan view of the roller ski board shown in FIG. 3.

Referring, to FIG. 9, another embodiment of the roller ski board is illustrated having an additional construction whereby its principle is almost similar to the embodiments of FIGS. 1 to 3.

A divided bushing set 5, as a soft material which has a flexible and elasticity property, a superior shock proof property such as rubber, synthetic resin, etc., held firmly on a roller shaft portion 6 is connected in a bearing through-hole 3*a* for a bearing portion 3 on the under-surface of the board body 1.

A connecting washer 6*a*, such a screw washer, coupling washer, lock washer, etc., is also effectively used for tightening the roller shaft portion 6.

Consequently, the divided bushing set 5 is prevented from slipping down from the bearing hole 3*a* due to an elastic pinch itself, while the roller shaft portion 6, from the through-hole 3*a* of the bearing portion 3 with the divided bushing set 5, due to tightening of the washer 6*a*.

Such parts of the roller may be constituted with respectively so that they can prevent effectively an injury of the bearing hole 3*a* and form a flexibility such as absorption of the shock and vibration on the bearing hole 3*a*, to improve remarkably a durability and sliding character of the roller board B.

A rotary wheel portion 7 of the roller S is made of the same material with the board B and rotate with a shaft portion 6 through a rotary core portion 8 which consists of an organic material having a superior wear-proof property.

The rotary core portion 8 can improve remarkably its rotary speed or durability by replacing it with a bearing shaft portion 9 including various bearings or oilless bearing, etc.

The rotary wheel portion 7 may have small or large through holes h, semi-circular through hole 7*b*, elliptical through hole, rectangular through hole, etc., and also be formed of various shape, such as a spoke like wheel or car-wheel etc., so that they have a superior war proof, a superior shock proof and a superior vibration proof property.

A roller body 11 made of an elastic soft material, such as a synthetic rubber or synthetic resin. is connected with the rotary wheel portion 7 through a wheel projection 7*a* and its outer surface may be provided with various uneven grooves 12, such as a thrust or radial pattern, so that the roller board can achieve a sharp edging effect, during the sliding, by exact contact with the ground surface of the outer periphery of the roller S, according to a condition of the sliding ground surface.

Furthermore, the roller body 11 may also be provided with lateral blind holes 13, such as a circular, semi-circular, elliptical or rectangular configuration, at an outer side surface portion, in order to absorb the vibrations and shocks from or to the ground.

Each width of rollers on the under surface 1*b* of the board body 1, may be different in a central portion, and each diameter may become smaller in order from the central portion 2 to both the front and rear edges 2*a*, 2*b* along an arc line L as shown in FIG. 5, so that the frictional resistance arising between the rollers S under both edges and the ground surface proportionally with the difference of tile diameter for each roller which is contacting with the ground, during sliding.

Accordingly, the board of the embodiments of the invention can be operated with a more easier smooth sliding, turning, circling, as an ordinary ski board.

Figure 10:
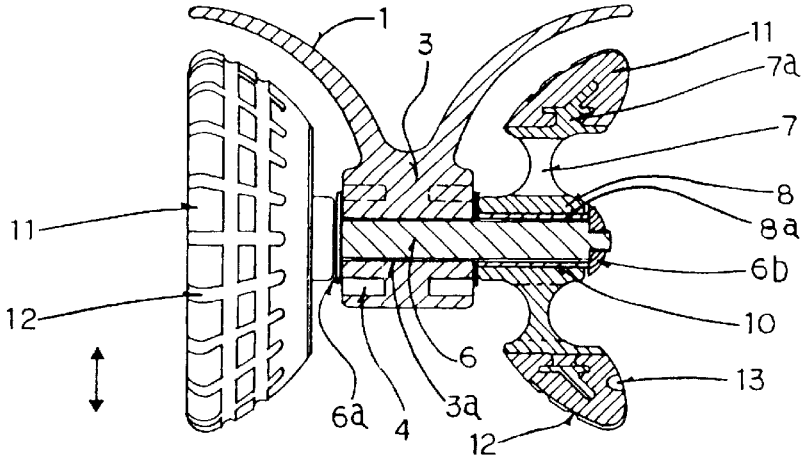
FIG. 10 is a partial sectional side view of one embodiment of a twin-roller.
Figure 11:
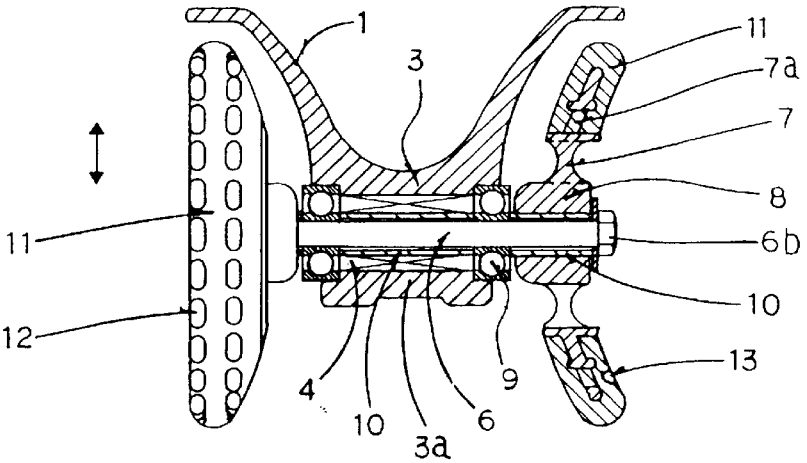
FIG. 11 is a partial sectional side view of another embodiment of the twin-roller.

Referring to FIGS. 10 and 11 another embodiment of the roller ski board is illustrated having an additional construction whereby its principle is almost similar to the embodiments of FIGS. 2 and 3.

Under-surface of the board body 1, the small twin roller pairs T on both edges 2*a*, 2*b*, which are respectively raised up and separated a little from tile central portion 2, prevent an over-turn of the user and guide the sliding direction.

All pairs of rollers are arranged on the under-surface of the board body 1 and respectively pivot rotatively at a respective position such that each circumference of the rollers contacts with a concave curvature L which is slightly curved upwardly from a horizontal tangent line H on the circumference of the roller at the central portion 2 of the board 1 to both edges.

The rotary wheel portion 7 are made of a same material as the board body 1 and also formed into various shapes such as spoke, car-wheel, block tire, etc.

The roller body 11 may be manufactured of a soft material having an elasticity such as rubber, synthetic resin. and it inside is connected with a rotary wheel portion 7 through a wheel projection 7*a*.

Each sliding surface of the roller body 11 may be provided with various uneven patterns 12, for example: a thrust pattern, radial pattern, according to a condition of the sliding ground surfaces. Further on an outer lateral periphery portion of the roller body 11 are also arranged at least one or more circular configuration, semi-circular configuration, elliptical configuration or rectangular configuration. etc., similar to the holes 13. Thus, the roller can permit weight reduction and remarkably absorb vibrations and shocks from or to the ground.

The rotary wheel portion 7 is rotated with a roller shaft portion 6 held firmly on a bearing hole 3*a* of a bearing portion 3.

A spacer material 10 inserted into between the shaft portion 6 and an inside surface of a rotary wheel hole 8*a*, so that bearing and slipping of the shaft portion 6 is prevented exactly to maintain a good rotation, during the sliding, due to an intervention effect of the material to the shaft portion 6.

The spacer material 10 is also connected firmly with the shaft portion 6 by a lock washer 6*a* and more-over the shaft portion 6 is tightened with a lock nut 6*b* such that it does not slip down from the bearing hole 3*a*.

A blind hole 14 may be arranged laterally in the bearing portion 3 of the board body 1, as shown in FIG. 11, to absorb vibrations and shocks of the board body 1, due to its cushion effect, and thus the spacer material 10, the washers 6*a* and the lock nut 6*b*, with the lateral blind hole 14, are held exactly on the bearing portion 3 the rotary shaft portion 6.

The rotary portion 8 of the rotary wheel portion 7 may be replaced by a roller bearing portion 9 such as various bearings or an oilless bearing, to increase the speed and reduce the friction.

Consequently the roller ski board can be operated smoothly and safely on a non-snow ground especially on a grass ground as an ordinary ski board on a snow field.

While there has been described and pointed out the fundamental features of the invention as applied to preferred embodiments, it will be understood that various omissions and substitutions and changes in the form and details of the roller ski board illustrated and many modifications may be made by those skilled in the art without departing from the spirit of the invention. The invention. therefore, is limited only as indicated by the scope of the following claims.

What is claimed is:

1. A roller ski board comprising:

a board body having a central portion and a longitudinal extent defined by respective side edges from a front edge portion to a rear edge portion, the board body having an under-surface having a longitudinal axis;

means forming a plurality of rotatable rollers, the plurality of rollers comprising a plurality of single rollers of substantially the same diameter disposed consecutively on the under-surface of the board body in the central portion;

means forming adjacent each respective front and rear edge portions a rotatable roller means comprising a pair of rollers arranged respectively consecutively along the longitudinal axis with the single rollers;

the board body having a curved contour extending from the front edge portion to the rear edge portion, the contour being concave with respect to a ground surface; and the single rollers and the pair of roller means having a radial periphery forming a tangential arc of an upward concave curvature with respect to the ground surface and wherein the arc extends between the front edge portion and the rear edge portion and has an orientation substantially opposite to the curved contour of the board body.

2. The roller ski body of claim 1 wherein the board body supports the single roller means by bearing portions, the board body and the bearing portions being formed from a light material, wherein the material is synthetic resin, glass fiber, metal or plywood, and wherein the material has a desired bending elasticity and the roller means having a core portion formed from a resin material wherein the resin material is hard plastics, semi-hard plastics or soft plastics.

3. The roller ski board of claim 1 wherein each roller means pivots so that a roller surface conforms to an arc curvature slightly curved upwardly over the contacting ground surface from the central portion to the front and rear edge portions.

4. The roller ski board of claim 1 wherein a vertical section through the single roller means has a running contact surface which forms a concave curvature relative to the contacting ground surface.

5. The roller ski board of claim 1 wherein a cross frame construction portion is formed at the under-surface of the board body at both the front and rear edges to increase the strength of the board body.

6. The roller ski board of claim 1 wherein the rollers have a wheel portion having various shapes comprising a spoke, car-wheel, or block.

7. The roller ski board of claim 1 wherein the roller means has a rotary shaft portion of a first material having a given hardness for supporting a roller bearing and a portion surrounding the rotary shaft portion of a second material having a lesser hardness than the first material.

8. The roller ski board of claim 1 comprising means for supporting a shaft for the respective roller means, the means for supporting comprising a bushing set portion connected to a bearing portion of the board, the bushing set portion comprising a material for absorbing vibrations and shocks.

9. The roller ski board of claim 1 wherein circular holes are disposed in the roller means about an outer surface of a rotary shaft of the roller means.

10. The roller ski board of claim 1 wherein the roller means has a plurality of holes.

11. The roller ski board of claim 1 wherein the roller means has an uneven peripheral pattern on a roller surface.

12. The roller ski board of claim 1 wherein the external periphery of the roller means does not extend laterally beyond the respective side edges of the board body.

13. The roller ski board of claim 1 wherein the board body with respect to the ground surface has a convex curvature in the central portion and upward convex curvature at the respective front and rear edge portions.

14. The roller ski board of claim 1 wherein the board body gradually widens from the central portion to the front edge portion and to the rear edge portion, respectively.

15. The roller ski board of claim 1 wherein the single rotatable roller means are disposed consecutively along the longitudinal axis on the under-surface of the board body and rotatable pair of roller means is respectively disposed at the front and rear edge portions and spaced from the central portion.

16. The roller ski board of claim 15 wherein the roller pair means disposed at the front and rear edge portions are vertically spaced from the ground surface.

17. The roller ski board of claim 1 wherein the front and rear edge portions have respective roller means on the under-surface of the board body and a diameter which is smaller than a diameter of the roller means disposed at the central portion.

18. The roller ski board of claim 1 wherein the single rotatable roller means are disposed consecutively along the longitudinal axis on the under surface of the board body, without any twin rotatable roller means interposed between any of the single rotatable roller means.

19. The roller ski board of claim 1 wherein the single rollers have respective external side peripheries forming a tangential arc of opposite orientation with respect to each other, which external side peripheries of the single rollers does not protrude beyond the side edges of the board body.

20. The roller ski board of claim 1 wherein the plurality of single rollers is rotatably mounted on respective shafts, the respective side edges of the board body extending downwardly to the shaft.

21. The roller ski board of claim 1 wherein the horizontal radial cross-section dimension through the plurality of rollers in the direction of the longitudinal axis is not the same for all of the plurality of rollers.

22. The roller ski board of claim 21 wherein the plurality of rollers comprises at least three rollers, and the horizontal cross-section dimension of a middle roller is different than the horizontal cross-section dimension of the remaining rollers.

23. The roller ski board of claim 1 wherein a bearing portion for each single roller extends downwardly from each respective side edge of the board body, each single roller being disposed between the bearing portions.

24. The roller ski board according to claim 1 wherein each single roller and each pair of rollers is rotatable about a respective shaft, the shafts being in substantially parallel relationship to each other.

25. A roller ski board comprising:

a plurality of single rollers of substantially the same diameter consecutively arranged along a central portion of a board body having a longitudinal extent defined by front and rear portions, the board body having an under-surface having a longitudinal axis;

a bearing portion of like plurality to the plurality of the single rollers extending downwardly from respective side edges of the board body;

the single rollers being supported to the board body by a respective shaft extending through a roller and between the bearing portions;

means forming a roller disposed adjacent the front and rear portions, the means forming a roller being arranged along the same longitudinal axis as the single rollers;

the outer periphery of the each single roller and each roller means forming a tangential arc extending between the front and rear portions having a curvature opposite to a curvature of the board body; and an external one side periphery of the single rollers forming a first tangential arc which is of opposite orientation to a second tangential arc formed by the other external side periphery of the single rollers wherein the external side peripheries do not protrude beyond the respective side edges of the board body.

26. The roller ski board according to claim 25 wherein each single roller and each means forming a roller is rotatable about a respective shaft, the shafts being in substantially parallel relationship to each other.

27. The roller ski board according to claim 25 wherein the curvature of the tangential arc is concave relative to a ground surface.

28. The roller ski board according to claim 25 wherein the first and second tangential arcs have a concave curvature with respect to the respective side periphery.

* * * * *